US005254274A

United States Patent [19]

Ho et al.

[11] Patent Number: 5,254,274

[45] Date of Patent: Oct. 19, 1993

[54] ALKYLAROMATIC LUBRICANT FLUIDS

[75] Inventors: Suzzy C. Ho, Plainsboro; Margaret M. Wu, Belle Mead, both of N.J.

[73] Assignee: Mobil Oil Corporation, Fairfax, Va.

[21] Appl. No.: 862,039

[22] Filed: Apr. 2, 1992

Related U.S. Application Data

[60] Division of Ser. No. 629,946, Dec. 19, 1990, Pat. No. 5,132,478, and a continuation-in-part of Ser. No. 402,378, Sep. 5, 1989, abandoned, each is a continuation-in-part of Ser. No. 293,911, Jan. 6, 1989, abandoned.

[51] Int. Cl.[5] ..... C10M 107/00; C10M 107/02

[52] U.S. Cl. ..... 252/45; 252/50; 252/52 R; 252/58; 585/11; 585/13; 585/24; 585/25; 585/26; 585/27

[58] Field of Search ..... 585/13, 25, 26, 27; 252/45, 50, 52 R, 58

[56] References Cited

U.S. PATENT DOCUMENTS

| | | | |
|---|---|---|---|
| 3,442,964 | 5/1969 | Oldham | 585/407 |
| 3,449,459 | 6/1969 | Asfazadourian | 260/671 |
| 4,013,736 | 3/1977 | Woo | 260/676 R |
| 4,211,665 | 7/1980 | Pellegrini, Jr. | 252/63 |
| 4,368,342 | 1/1983 | Slaugh | 585/446 |
| 4,714,794 | 12/1987 | Yoshida et al. | 585/26 |
| 4,731,497 | 3/1988 | Grey | 585/455 |
| 4,827,064 | 5/1989 | Wu | 585/10 |
| 4,827,073 | 5/1989 | Wu | 585/530 |
| 4,912,277 | 3/1990 | Aufdembrink et al. | 585/467 |
| 4,914,254 | 4/1990 | Pelrine | 585/530 |
| 4,990,718 | 2/1991 | Pelrine | 585/455 |
| 5,015,795 | 5/1991 | Pelrine | 585/330 |
| 5,019,670 | 5/1991 | Le et al. | 585/467 |
| 5,087,782 | 2/1992 | Pelrine | 585/417 |
| 5,107,049 | 4/1992 | Le et al. | 585/26 |
| 5,132,477 | 7/1992 | Ho et al. | 585/26 |
| 5,132,478 | 7/1992 | Ho et al. | 585/467 |

FOREIGN PATENT DOCUMENTS

| | | | |
|---|---|---|---|
| 1093340 | 7/1956 | Fed. Rep. of Germany | 585/459 |
| 2541079 | 12/1976 | Fed. Rep. of Germany | 585/459 |
| 1441491 | 2/1965 | France | 585/459 |
| 2414543 | 9/1979 | France . | |
| 635122 | 2/1979 | U.S.S.R. | 585/459 |
| 2078776A | 6/1980 | United Kingdom . | |

*Primary Examiner*—Ellen M. McAvoy
*Attorney, Agent, or Firm*—Alexander J. McKillop; Malcolm D. Keen

[57] ABSTRACT

Aromatic compounds are alkylated with $C_{20}$–$C_{1300}$ olefinic oligomers using an acidic alkylation catalyst to produce alkylated aromatic products, usually alkylaromatic hydrocarbons. The olefinic oligomers used as alkylating agents are prepared from 1-alkene oligomerization in contact with reduced metal oxide catalyst, preferably reduced chromium oxide on a silica support. The alkylated aromatic hydrocarbons retain the unique features of the alkylating olefinic oligomer and exhibit high viscosity index and low pour point. If the alkylation is carried out under certain combinations of conditions, especially using a Lewis acid catalysts such as aluminum trichloride and at higher temperatures, the alkyl portion of the product will undergo isomerization. The alkylaromatic compositions show improved thermal stability and are useful as lubricant basestocks and additives for improved antiwear properties, antioxidant and other properties.

10 Claims, 2 Drawing Sheets

ALKYLAROMATIC LUBRICANT FLUIDS

CROSS REFERENCE TO RELATED APPLICATIONS

This application is a division of copending application Ser. No. 07/629,946, filed on 19 Dec. 1990, now U.S. Pat. No. 5,132,478, which is a continuation-in-part of prior application Ser. No. 7/293,911, filed 6 Jan. 1989, now abandoned; it is also a continuation-in-part of Ser. No. 07/402,378, filed 5 Sep. 1989, now abandoned; which itself is a continuation-in-part of Ser. No. 07/293,911. The disclosures of Serial Nos. 07/293,911 and 07/402,378 are incorporated in this application by reference.

FIELD OF THE INVENTION

This invention relates to alkylated aromatic compositions useful as lubricant basestock and lubricant additives and to preparation. More particularly, the invention relates to novel lubricant compositions having high viscosity index,,,, (VI) and increased thermal stability prepared by alkylating aromatics with polyalpha-olefin oligomers of high VIB and low pour point.

BACKGROUND OF THE INVENTION

Efforts to improve the performance of natural mineral oil based lubricants by the synthesis of oligomeric hydrocarbon fluids have been the subject of important research and development in the petroleum industry for at least fifty years and have led to the relatively recent market introduction of a number of superior polyalpha-olefin (PAO) synthetic lubricants, primarily based on the oligomerization of alpha-olefins or 1-alkenes. In terms of lubricant property improvement, the thrust of the industrial research effort on synthetic lubricants has been toward fluids exhibiting useful viscosities over an extended range of temperature,i.e.,improved viscosity index, while also showing good lubricity, thermal and oxidative stability and pour point equal to or better than mineral oils. These new synthetic lubricants may exhibit lower friction and hence increase the mechanical efficiency of the equipment in which they are used, for example, mechanical loads such as worm gears, gear sets, and traction drives as well as in engines and they may do so over a wider range of operating conditions than mineral oil lubricants.

Notwithstanding their generally superior properties, PAO lubricants are often formulated with additives to enhance those properties for specific applications. The more commonly used additives include oxidation inhibitors, rust inhibitors, metal passivators, antiwear agents, extreme pressure additives, pour point depressants, detergent-dispersants, viscosity index (VI) improvers, foam inhibitors and the like, as described, for example, in Kirk-Othmer "Encyclopedia of Chemical Technology", 3rd edition, Vol. 14, pp. 477–526, to which reference is made for a description of such additives and their use. Significant improvements in lubricant technology have come from improvements in additives.

Improvements have also come from new base fluid development for inherently better properties. Alkylated aromatics, particularly alkylated naphthalenes, are known to possess useful antiwear properties, thermal and oxidative stability as disclosed in U.S. Pat. Nos. 4,211,665, 4,238,343, 4,604,491 and 4,714,7944, making them suitable for use as heat transfer fluids and functional fluids. The antiwear properties of alkylnaphthalene lubricating fluids are disclosed in Khimiya i Tekhnologiya Topliv i Masel, No. 8, pp. 28–29, August, 1986.

Recently, high VI lubricant compositions (referred to here as HVI-PAO) comprising polyalpha-olefins have been disclosed in U.S. Pat. Nos. 4,827,064 and 4,827,073. The process for making these materials comprises, briefly, oligomerizing a $C_6$–$C_{20}$ 1-alkene feedstock such as 1-decene with a reduced valence state Group VIB metal catalyst, preferably a reduced chromium oxide on a porous silica support, to produce high viscosity, high VI, liquid hydrocarbon oligomers which have a characteristic structure with a branch ratio less than 0.19. The oligomers are also characterized by good flow properties, ususally having a pour point below −15° C. Lubricants produced by the process cover the full range of viscosities from low viscosity lubricants such as 5cS fluids to higher viscosity lubricant additives useful as VI improvers, for instance, oligomers having a viscosity of 1,000 cS or more, as described in application Ser. No. 07/345,606, to which reference is made for a description of these high viscosity materials and their preparation. These high viscosity oligomers, too, exhibit a remarkably high VI and low pour point even at high viscosity. The as-synthesized HVI-PAO oligomer has olefinic unsaturation associated with the last of the recurring monomer units in the structure and accordingly, the oligomer will ususally be subjected to a final hydrogentation treatment in order to reduce residual unsaturation to make a final, fully stable product.

SUMMARY OF THE INVENTION

In spite of the notable improvements brought about by the HVI-PAO lubricants, there remains a need to make further improvements in their properties, particularly in their thermal and oxidative stability. We have now found, however, that these properties can be improved by reacting the HVI-PAO oligomers with aromatic compounds, to alkylate the aromatics and incorporate the HVI-PAO structure into them. The products, which are useful for lubricant purposes, have improved thermal stability, high viscosity index and other desirable properties as described below.

The present invention, therefore, is directed to a method of making the improved HVI-PAO materials by reacting aromatic compounds in a Frieder-Crafts type reaction with olefinic HVI-PAO oligomers to produce alkylated aromatic products. The novel HVI-PAO alkylated aromatics retain the unique structurally-related features of the alkylating HVI-PAO olefinic oligomer and therefore exhibit an extraordinary combination of properties relating to high viscosity index and low pour point which makes them very useful as lubricant base stocks and additives as well as having potential as intermediates for the production of other lubricant additives. The HVI-PAO alkyl aromatic compositions show improved thermal stability.

The HVI-PAO alkylated aromatics can be prepared from HVI-PAO oligomers having a wide rqange of viscosities from very low to very high, as an alkylating agent for monocyclic aromatics such as benzene or phenol or polycyclic aromatics such as naphthalene. Depending upon the HVI-PAO molecular weight range and the substituent groups on the aromatic nucleus, the products may be useful as lubricant basestocks or additives for improved antiwear properties, antioxidant and other properties.

The alkylation reaction between the HVI-PAO olefinic oligomer and the aromatic compound is carried out in the presence of a catalyst having acidic activity in order to obtain the desired alkylation reactions. Catalysts may be either solid or liquid (heterogeneous or homogeneous) and may exhibit Lewis acid activity or Bronsted acid activity, for example, with homogeneous catalysts such as aluminum trichloride, boron trifluoride or complexes of boron trifluoride which have Lewis acid functionality or heterogeneous catalysts such as the acidic zeolites which are generally regarded as exhibiting Bronsted acid activity.

The HVI-PAO alkylaromatic hydrocarbon has a significantly reduced degree of unsaturation as compared to the oligomer which is used to prepare the alkylaromatic so that hydrogenation of the product can be eliminated both for low and high viscosity materials, although it may be nevertheless desirable to carry out a hydrogenation step after the alkylation in order to ensure the stability of the final product.

Depending upon the catalyst and the reaction conditions, the alkylation may proceed with skeletal isomerization of the alkylating species so that the final alkylaromatic product may possess a different structure in the alkyl portion of the molecule than the starting oligomer. Isomerization is generally favored by the use of higher temperatures during the alkylation reaction, usually above about 200° C., although the Lewis acid catalysts such as aluminum trichloride and boron trifluoride will effect a significant degree of isomerization at lower temperatures.

The alkylated aromatic products, usually hydrocarbons, which are obtained when there is no substantial degree of isomerization, have the structure:

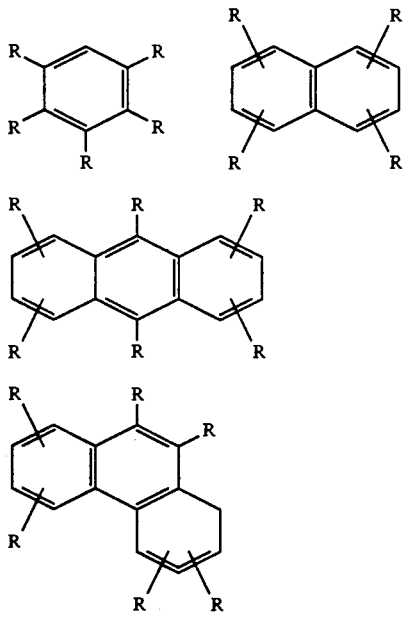

where at least one R group is the hydrocarbon residue of the polymerization of $C_2$–$C_{20}$ 1-alkene. This residue typically has a branch ratio less than 0.19, a weight average molecular weight between 280 and 450,000, number average molecular weight between 280 and 450,000 and a molecular weight distribution between 1 and 5. The remaining R groups are hydrogen, $C_1$–$C_{20}$ cyclic or acyclic alkyl and alkenyl, aryl, $NH_2$, acylamido, halogen, acyl, $NO_2$, YO where Y is hydrogen, acyl, alkoxycarbonyl, phenyl and $C_1$–$C_{20}$ cyclic or acyclic alkyl and alkenyl. Where a significant degree of skeletal isomerization of the alkyl portion of the molecule has occurred, the products have comparable structures in which at least one R group will be the partially isomerized hydrocarbon residue of HVI-PAO.

DETAILED DESCRIPTION

Figure 1:
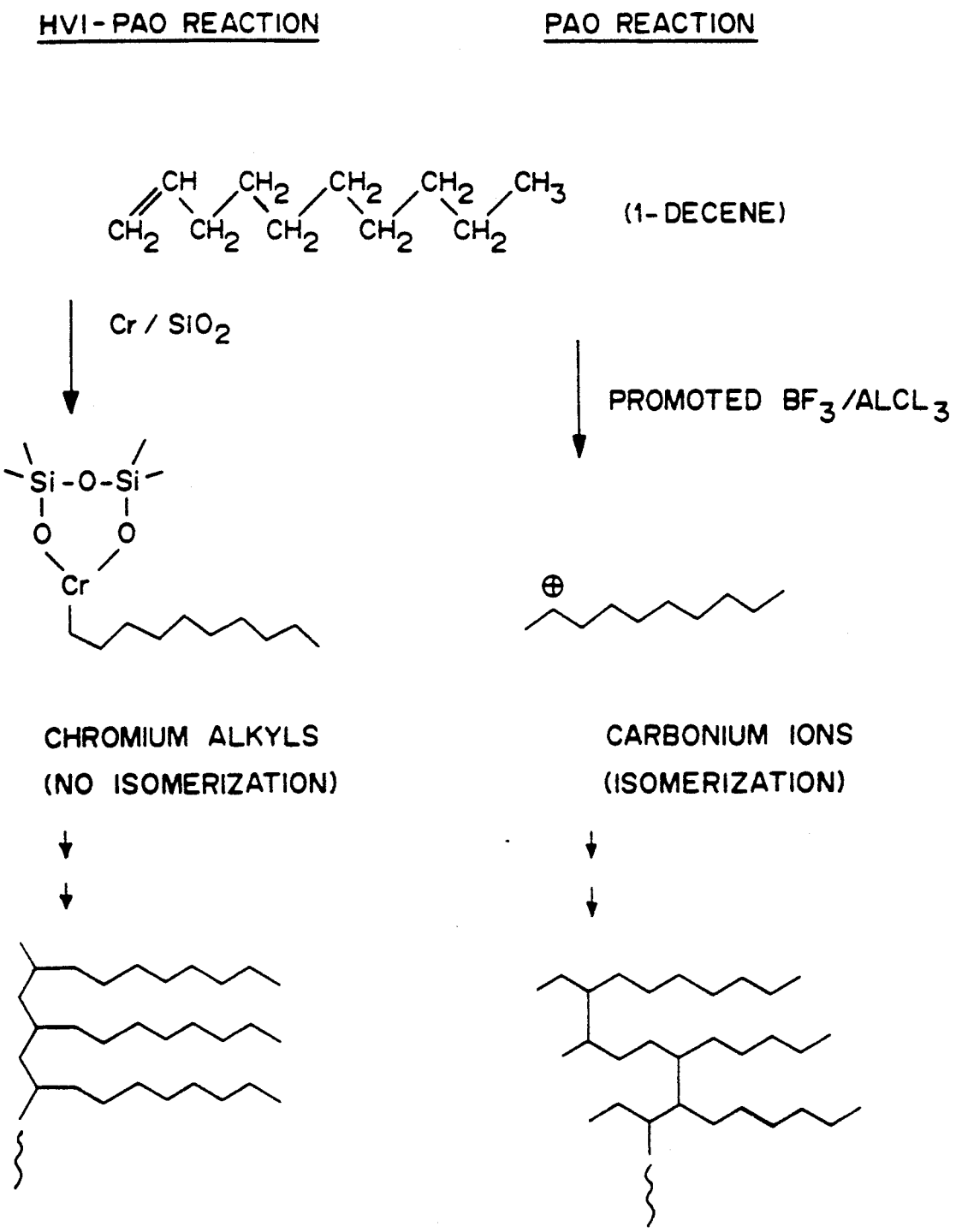
FIG. 1 is a graphical comparison of PAO and HVI-PAO properties.

In the present invention aromatic hydrocarbons, including substituted aromatic hydrocarbons, are alkylated with olefin oligomers produced from the oligomerization of 1-alkenes by the use of an oligomerization catalyst comprising reduced Group VIB metal catalyst, preferably reduced chromium oxide on a silica support. As oligomerized, these HVI-PAO oligomers are mixtures of dialkyl vinylidenic and 1,2 dialkyl or trialkyl monoolefin oligomers, as described in U.S. Pat. Nos. 4,827,064 and 4,827,073, to which reference is made for a description of these olefin oligomers, their properties and their preparation. Oligomerization with the novel reduced Group VIB metal catalyst, e.g. the reduced chromium catalyst leads to an oligomer substantially free of double bond isomerization. The acid catalysts such as $AlCl_3$ or $BF_3$ used to make conventional PAO form a carbonium ion which, in turn, promotes isomerization of the olefinic bond and the formation of multiple isomers. The HVI-PAO oligomers used in the present invention have a structure with a $CH_3/CH_2$ ratio $<0.19$ compared to a ratio of $>0.20$ for conventional PAO.

Olefins

Olefins suitable for use as starting material in the preparation of the olefinic HVI-PAO dimers and oligomers include olefins containing from 2 to about 20 carbon atoms such as ethylene, propylene, 1-butene, 1-pentene, 1-hexene, 1-octene, 1-decene, 1-dodecene and 1-tetradecene and branched chain isomers such as 4-methyl-1-pentene. Also suitable for use are olefin-containing refinery feedstocks or effluents. However, the olefins used in this invention are preferably alpha-olefinic as for example 1-hexene to 1-hexadecene and more preferably 1-octene to 1-tetradecene, or mixtures of such olefins.

Oligomerization

The unsaturated HVI-PAO alpha-olefin oligomers are prepared by oligomerization reactions in which a major proportion of the double bonds of the alpha-olefins are not isomerized. These reactions include alpha-olefin oligomerization by supported metal oxide catalysts, such as Cr compounds on silica or other Group VIB (IUPAC Periodic Table) compounds. The catalyst most preferred is a lower valence Group VIB metal oxide on an inert support. Preferred supports include silica, alumina, titania, silica alumina, magnesia aluminum phosphate and the like.

The support material usually has high surface area and large pore volumes with average pore size of 40 to about 350 Angstroms. Porous substrates having a pore opening of at least 40 Å are preferred. The high surface area are beneficial for supporting large amount of highly dispersive, active chromium metal centers and to give maximum efficiency of metal usage, resulting in very high activity catalyst. The support should have large average pore openings of at least 40 Å, with an average pore opening of 60 to 300 Å preferred. This large pore opening will not impose any diffusional restriction of the reactant and product to and away from the active catalytic metal centers, thus further optimizing the catalyst productivity. Also, for this catalyst to be used in fixed bed or slurry reactor and to be recycled and regenerated many times, a silica support with good physical strength is preferred to prevent catalyst particle attrition or disintegration during handling or reaction.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO, $H_2$, $NH_3$, $H_2S$, $CS_2$, $CH_3SCH_3$, $CH_3SSCH_3$, metal alkyl containing compounds such as $R_3Al$, $R_3B$,$R_2Mg$, RLi, $R_2Zn$, where R is alkyl , alkoxy, aryl and the like. Preferred are CO or $H_2$ or metal alkyl containing compounds. Alternatively, the Group VIB metal may be applied to the substrate in reduced form, such as CR(II) compounds. The resultant catalyst is very active for oligomerizing olefins at a temperature range from below room temperature to about 250° C. at a pressure of 0.1 atmosphere to 5000 psi. Contact time of both the olefin and the catalyst can vary from one second to 24 hours. The catalyst can be used in a batch type reactor or in a fixed bed, continuous-flow reactor.

In general the support material may be added to a solution of the metal compounds, e.g., acetates or nitrates, etc., and the mixture is then mixed and dried at room temperature. The dry solid gel is purged at successively higher temperatures to about 600° for a period of about 16 to 20 hours. Thereafter the catalyst is cooled down under an inert atmosphere to a temperature of about 250° to 450° C. and a stream of pure reducing agent is contacted therewith for a period when enough CO has passed through to reduce the catalyst as indicated by a distinct color change from bright orange to pale blue. Typically, the catalyst is treated with an amount of CO equivalent to a two-fold stoichiometric excess to reduce the catalyst to a lower valence Cr(II) state. Finally the catalyst is cooled down to room temperature and is ready for use.

Oligomer Alkylating Agents

The process used to produce HVI-PAO oligomers can be controlled to yield oligomers having weight average molecular weight between 280 and 450,000 and number average molecular weight between 280 and 180,000. Measured in carbon numbers, molecular weights range from $C_{20}$ to $C_{13000}$ and viscosity up to 7500 cs at 100° C., with a preferred range of $C_{30}$ to $C_{1000}$ and a viscosity of up to 1000 cS at 100° C. for lube base stock material and additives. Molecular weight distributions (MWD), defined as the ratio of weight average molecular to number average molecular weight, range from 1.00 to 5, with a preferred range of 1.01 to 3 and a more preferred MWD of about 1.05 to 2.5. Viscosities of the olefinic HVI-PAO oligomers used as alkylating agent measured at 100° C. may range from 1.5 cS to 7500 cS, although about 1000 cS is a more common upper limit on the viscosity.

The product oligomers also have atactic molecular structure of mostly uniform head-to-tail connections with some head-to-head type connections in the structure. These low branch ratio oligomers have high viscosity indices at least about 15 to 20 units and typically 30–40 units higher than equivalent viscosity prior art oligomers, which regularly have higher branch ratios and correspondingly lower viscosity indices. These low branch oligomers maintain better or comparable pour points.

The product oligomers may have a very wide range of viscosities with high viscosity indices suitable for high performance lubrication use, possibly as lubricant additives e.g. VI improvers, as described in Serial No. 07/345,606 as well as for lubricant basestocks as described in U.S. Pat. Nos. 4,827,064 and 4,827,073.

The branch ratios defined as the ratios of $CH_3$ groups to $CH_2$ groups in the lube oil are calculated from the weight fractions of methyl groups obtained by infrared methods, published in *Analytical Chemistry*, Vol. 25, No. 10, p. 1466 (1953).

$$\text{Branch ratio} = \frac{\text{wt fraction of methyl group}}{1 - (\text{wt fraction of methyl group})}$$

Structurally, the HVI-PAO oligomers have the following regular head-to-tail structure where n is preferably 0 to 17, terminating in olefinic unsaturation:

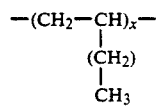

with some head-to-head connections. The as-synthesized HVI-PAO molecular structure generally has one double bond unsaturation. In addition, the dimer produced as a by-product of the HVI-PAO oligomerization is rather simpler than the dimer produced by 1-alkene oligomerization with $BF_3$ or $AlCl_3$. Typically, a significant proportion of unhydrogenated dimerized 1-alkene has a vinylidenyl structure:

where $R_1$ and $R_2$ are alkyl groups representing the residue from the head-to-tail addition of 1-alkene molecules. For example, 1-decene HVI-PAO dimer, which can be used as the alkylating olefin in the present invention, has been found to contain only three major components, as determined by GC. Based on $C^{13}$ NMR analysis, the unhydrogenated components were found to be 8-eicosene, 9-eicosene, 2-octyldodecene and 9-methyl-8-nonadecene or 9-methyl-9-nonadecene.

Figure 2:
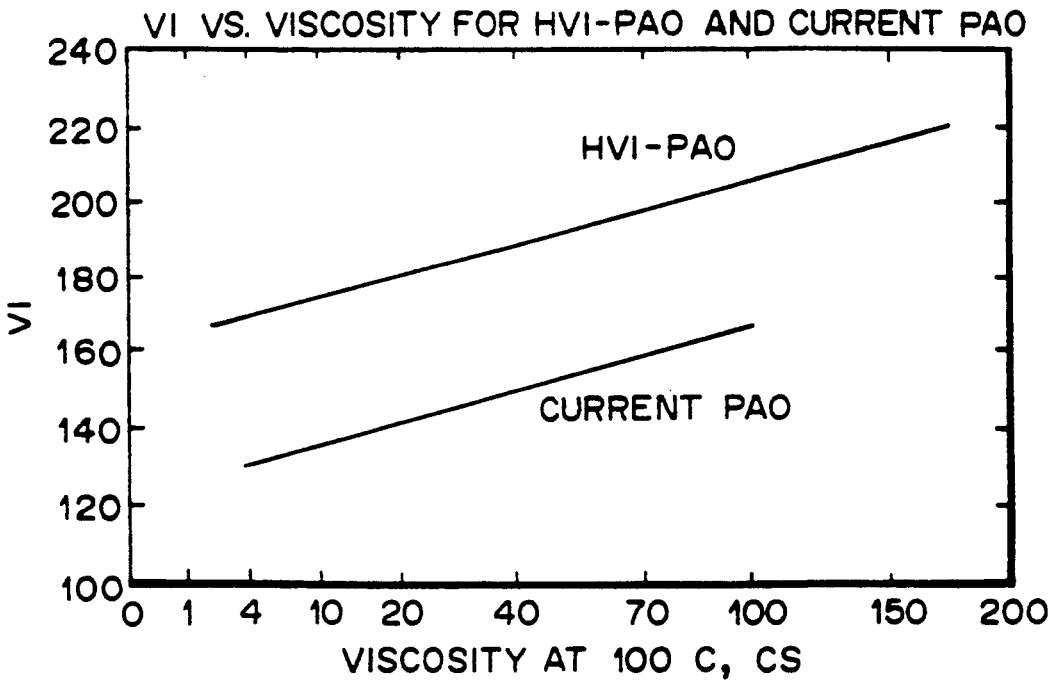
FIG. 2 is a graphical comparison of VI for PAO and HVI-PAO

Referring to FIG. 1, the olefinic oligomers (HVI-PAO) used as starting material for the alkylation are compared (after hydrogenation) with conventional polyalphaolefins (PAO) from 1-decene. FIG. 2 compares the viscosity index/viscosity relationship for HVI-PAO and PAO lubricants, showing that HVI-PAO is distinctly superior to PAO at all viscosities tested. Remarkably, despite the more regular structure of the HVI-PAO oligomers as shown by branch ratio that results in improved viscosity index (VI), they have lower pour points than conventional to PAO. Conceivably, oligomers of regular structure containing fewer isomers would be expected to have higher solidification temperatures and higher pour points, reducing their utility as lubricants. Surprisingly this is not the case for the HVI-PAO materials.

Alkylation

The HVI-PAO alkylaromatic derivatives are prepared in a Friedel-Crafts type acid catalyzed alkylation reaction. Acid catalysts which may be used include the typical Friedel-Crafts type catalysts, which may be either liquid (homogeneous) and solid (heterogeneous) catalysts including Lewis acids such as, but not limited to, $BF_3$, $AlCl_3$, HCl , HF, HBr, $H_2SO_4$, $H_3PO_4$, $P_2O_5$, $SO_3$, $SnCl_4$, $FeCl_3$, $ZnCl_2$, $TiCl_4$ and $SbCl_5$. Solid acidic catalysts such as those exhibiting Bronsted acidic activity, for example, acidic zeolites as well as acidic clay catalysts or amorphous aluminosilicates may also be used, particularly zeolites such as ZSM-5 in the protonic form and organic cation exchange resins (which can be regarded as solid acids) such as R-$SO_3H$ where R is a polymeric resin such as sulfonated polystyrene. Preferred catalysts are $AlCl_3$, $BF_3$, acidic zeolites such as Zeolite Beta, Zeolite Y, ZSM-5, ZSM-35 and Amberlyst 15, obtainable from Rohm & Haas.

Aromatic compounds which may be used in the present invention include aromatic hydrocarbons such as substituted and unsubstituted benzene and polynuclear aromatic compounds, particularly naphthalene, anthracene and phenanthracene. Typical aromatic compounds which may be used include benzene, toluene, o,m,p-xylene, hemimel-litene, pseudocumene, ethylbenzene, n-propylbenzene, cumene, n-butylbenzene, isobutylbenzene, sec-butylbenzene, tert-butylbenzene, p-cymene, biphenyl, diphenylmethane, triphenyl methane, 1,2-diphenylethane and similarly alkyl substituted naphthalenes and anthracenes; also phenol, catechol, acylphenol such as acetylphenol, carbonate esters such as phenyl methyl or ethyl carbonate and diphenyl carbonate, alkylphenol such as anisole, chloro and bromo-benzene, aniline, acyl aniline such as acetanil-ide, methyl and ethylben-zoate, thiophenol and acylated thiophenol, nitrobenz-ene, diphenylether, diphenylsulfide and similarly substituted naphthalenes and anthracenes, in particular naphthols such as mono and dihydroxy naphthalene.

The alkylation process conditions suitably comprise temperature between −30° and 350° C., typically at a temperature between 30° and 90° C. e.g. 60° C. with a pressure typically between 700 and 7000 kPa. Under conditions of greater severity the alkylation tends to be accompanied by isomerization of the HVI-PAO oligomer either before or after the attachment to the aromatic compound so that the alkylaromatic product will contain an isomerized HVI-PAO moiety. At alkylation temperatures below about 200° C., the Lewis acid catalysts such as aluminum trichloride and boron trifluoride will promote isomerization, with the extent of isomerization increasing with increasing temperature. At temperatures above about 200° C. the solid catalysts such as the zeolites will also promote isomerization.

The weight ratio of HVI-PAO starting material to catalyst is typically between 1000:1 and 5:1, preferably 500:1 to 10:1. The weight ratio of HVI-PAO starting material to aromatic compound(s) e.g. benzene, naphthalene, 1,2,4-tri-methyl-benzene, is typically between 1000:1 and 5:1, preferably 500:1 to 4:1, but depending upon the degree of alkylation of the aromatic which is desired—or, conversely, aromatization of the HVI-PAO—the ratio may be altered accordingly. The alkylaromatic products which retain a significant degree of the properties of the HVI-PAO oligomer typically contain at least 65% weight percent of HVI-PAO hydrocarbon moiety and for such products the molar ratio of the HVI-PAO oligomer to the aromatic component of the reaction will normally be at least 1:1, preferably at least 1.5:1 (oligomer:aromatic)In other cases, the molar ratio of the oligomer to the aromatic component of the reaction should be chosen to provide the desired type of product. For example, if the aromatic/alkyl moiety ratio is to be about 1:1, a ratio of about 1:1 (molar) will be appropriate, although some variation from this will be necessary depending upon the relative reactivities of the two reactant species. In most cases, molar ratios of from 0.1:1 to 10:1, more usually 0.2:1 to 5:1, will be used.

After the alkylation reaction has taken place, the aromatic compounds are converted to alkylaromatics having structures such as:

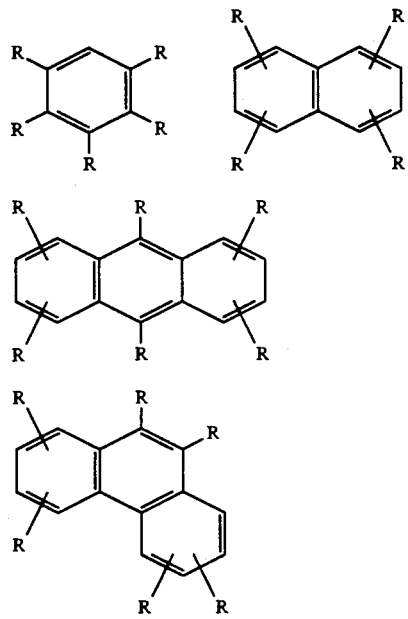

where at least one R group is the hydrocarbon HVI-PAO residue of the polymerization of the $C_2$–$C_{20}$ 1-alkene. As noted above, this residue typically has a branch ratio less than 0.19 although if a significant degree of isomerization takes place during the alkylatiuon reaction, the branch ratio of the R groups introduced from the oligomer may vary somewhat and may exceed the value of 0.19 which is characterisitc of the HVI-PAO oligomers. The weight average molecular weight is between 300 and 45,000, number average molecular weight between 300 and 18,000, molecular weight distribution between 1 and 5. The remaining R groups are usually hydrogen or hydrocarbon groups such as $C_1$–$C_{20}$ cyclic or acyclic alkyl but may also be any of the groups set out in the formulae above.

The HVI-PAO groups referred to above normally comprise a partially isomerized vinylidenyl radical having the structure:

$R_1R_2C—CH_3$ where $R_1$ and $R_2$ may be alike or different and comprise the HVI-PAO oligomeric isomerized moiety having a generally head-to-tail repeating structure of $C_2$–$C_{20}$ 1-alkenes where oligomers of $C_6$–$C_{20}$ 1-alkenes have a $CH_3/CH_2$ ratio less than 0.20, preferably between 0.14 and 0.19. HVI-PAO and the hydrocarbon HVI-PAO residue may contain between 20–13000 carbon atoms preferably between 30–1000 carbon atoms. The viscosities of the products are typically between 2 cS and 7500 cS, measured at 100° C. with low viscosity products being from about 2 to 100 cS. VI values are usually in excess of about 130. The bromine numbers of the unhydrogenated products may be form about 0 to about 12, typically from 0.1 to 12, usually from 0 to 3. Hydrogenation of the alkylated product may result in very low bromine numbers. Pour points are usually below −15° C., and may be below −30° C.

The introduction of aromatic compounds into an alpha-olefin oligomer results in a new class of lubricant basestock with superior thermal and oxidative stabilities, better additive solvency, and seal swell capacity while maintaining the high VI and low pour properties. It also eliminates the conventional hydro-finishing step usually required for the lubricant basestock.

The products of the alkylation process are useful as lubricant basestock and as additives. The introduction of the aromatic moiety into the HVI-PAO increases thermal stability, increases solubilizing power of the product and adds other properties useful in additives such as antiwear properties and VI enhancement. It also eliminates the conventional hydrofinishing step usually required for the lubricant basestock. As additives, the usefulness of the products is compounded by the incorporation additional capabilities in a single product, for example, the capability to improve a lube basestock thermal stability, VI, solvency and seal swelling power as well as improving antiwear characteristics. They possess the further advantage of great flexibility in the range of viscosity in which they can be prepared so that their additive properties can be used in a viscosity compatible with the viscosity formulation of the lube basestock. The lubricant compositions of the instant invention can be useful as additives such as dispersants, detergents, viscosity index improvers, extreme pressure/antiwear additives, antioxidants, pour depressants, emulsifiers, demulsifiers, corrosion inhibitors, antirust inhibitors, antistaining additives, friction modifiers, and the like.

The introduction of phenolic compounds into the alpha-olefin oligomers results in a new class of lubricant basestock with superior thermal and oxidative stabilities, better additive solvency, and seal swell capacity while maintaining the high VI and low pour properties which are characteristic of the starting HVI-PAO oligomers.

Examples 1–7 below illustrate the preparation of HVI-PAO olefinic oligomrs used as the starting material.

EXAMPLE 1

Catalyst Preparation and Activation Procedure 1.9 grams of chromium (II) acetate ($Cr_2(OCOCH_3)_42H_2O$) (5.58 mmole) (commercially obtained) was dissolved in 50 cc of hot acetic acid. Then 50 grams of a silica gel of 8–12 mesh size, a surface area of 300 $m^2/g$, and a pore volume of 1 cc/g, also is added. Most of the solution is absorbed by the silica gel. The final mixture was mixed for half an hour on a Rotavap at room temperature and dried in an open-dish at room temperature. The dry solid (20 g) was purged with $N_2$ at 250° C. in a tube furnace, after which the furnace temperature was raised to 400° C. for 2 hours. The temperature was then set at 600° C. with dry air purging for 16 hours. At this time the catalyst was cooled down under $N_2$ to a temperature of 300° C. A stream of pure CO (99.99% from Matheson) was then introduced for one hour. Finally, the catalyst was cooled down to room temperature under $N_2$ and ready for use.

EXAMPLE 2

The catalyst prepared in Example 1 (3.2 g ) was packed in a ⅜" stainless steel tubular reactor inside an $N_2$ blanketed dry box. The reactor under $N_2$ atmosphere was then heated to 150° C. by a single-zone Lindberg furnace. Pre-purified 1-hexene was pumped into the reactor at 140 psi and 20 cc/hr. The liquid effluent was collected and stripped of the unreacted starting material and the low boiling material at 0.05 mm Hg. The residual clear, colorless liquid had viscosity characteristics and VI suitable as a lubricant base stock.

TABLE 1

| Sample | Prerun | 1 | 2 | 3 |
|---|---|---|---|---|
| T.O.S., hr. | 2 | 3.5 | 5.5 | 21.5 |
| Lube Yield, wt % | 10 | 41 | 74 | 31 |
| Viscosity, cS, at | | | | |
| 40° C. | 208.5 | 123.3 | 104.4 | 166.2 |
| 100° C. | 26.1 | 17.1 | 14.5 | 20.4 |
| VI | 159 | 151 | 142 | 143 |

EXAMPLE 3

In a manner similar to Example 2, a fresh catalyst sample was charged into the reactor and 1-hexene pumped to the reactor at 1 atm and 10 cc per hour. As shown in Table 2 below, a lube of high viscosities and high VI was obtained. These runs show that at different reaction conditions, a lube product of high viscosity can be obtained.

TABLE 2

| Sample | A | B |
|---|---|---|
| T.O.S., hrs. | 20 | 44 |
| Temp., °C. | 100 | 50 |
| Lube Yield, % | 8.2 | 8.0 |
| Viscosities, cS at | | |
| 40° C. | 13170 | 19011 |
| 100° C. | 620 | 1048 |
| VI | 217 | 263 |

EXAMPLE 4

A commercial chrome/silica catalyst which contained 1% Cr on a large-pore volume synthetic silica gel was used. The catalyst was first calcined with air at 800° C. for 16 hours and reduced with CO at 300° C. for 1.5 hours. Then 3.5 g of the catalyst was packed into a tubular reactor and heated to 100° C. under the $N_2$ atmosphere. 1-Hexene was pumped through at 28 cc per hour at 1 atmosphere. The products were collected and analyzed as set out in Table 3:

TABLE 3

| Sample | C | D | E | F |
|---|---|---|---|---|
| T.O.S., hrs. | 3.5 | 4.5 | 6.5 | 22.5 |

TABLE 3-continued

| Sample | C | D | E | F |
|---|---|---|---|---|
| Lube Yield, % | 73 | 64 | 59 | 21 |
| Viscosity, cS, at | | | | |
| 40° C. | 2548 | 2429 | 3315 | 9031 |
| 100° C. | 102 | 151 | 197 | 437 |
| VI | 108 | 164 | 174 | 199 |

These runs show that different Cr on silica catalysts are effective for oligomerizing olefins to lube products.

EXAMPLE 5

A commercial Cr on silica catalyst which contained 1% Cr on a large pore volume synthetic silica gel was used. The catalyst was first calcined with air at 700° C. for 16 hours and reduced with CO at 350° C. for one to two hours. 1.0 part by weight of the activated catalyst was added to 1-decene of 200 parts by weight in a suitable reactor and heated to 185° C. 1-Decene was continuously fed to the reactor at 2–3.5 parts/minute and 0.5 parts by weight of catalyst added for every 100 parts of 1-decene feed. After 1200 parts of 1-decene and 6 parts of catalyst were charged, the slurry was stirred for 8 hours. The catalyst was filtered off and light product boiling below 150° C. @ 0.1 mm Hg was stripped. The residual product is hydrogenated with a Ni on Kieselguhr catalyst at 200° C. The finished product had a viscosity at 100° C. of 18.5 cs, VI of 165 and pour point of −55° C.

EXAMPLE 6

As Example 5, except reaction temperature was 125° C. The finished product had a viscosity at 100° C. of 145 cs, VI of 214, pour point of −40° C.

EXAMPLE 7

As Example 5, except reaction temperature was 100° C. The finished product had a viscosity at 100° C. of 298 cs, VI of 246 and pour point of −32° C.

The following Table 4 summarizes the molecular weights and distributions of Examples 5 to 7.

TABLE 4

| Example | 5 | 6 | 7 |
|---|---|---|---|
| V @ 100° C., cS | 18.5 | 145 | 298 |
| VI | 165 | 214 | 246 |
| Number-average molecular weight $MW_n$ | 1670 | 2062 | 5990 |
| Weight-average molecular weight $MW_w$ | 2420 | 4411 | 13290 |
| Molecular weight distribution, MWD | 1.45 | 2.14 | 2.22 |

Under similar conditions, HVI-PAO product with viscosity as low as 1.5 cs and as high as 7500 cs, with VI between 130 and 350, can be produced.

EXAMPLE 8

This example illustrates the alkylation process.

To a slurry of 7.3 g of aluminum chloride in 200 mL of toluene at room temperature 102 g. of the HVI-PAO polyalpha-olefin with a viscosity of 18 cs measured at 100° C. was slowly added. The addition was at a rate so as to keep the temperature below 30° C. The mixture was stirred for 12 hours and then quenched with water, washed with dilute HCl and dried over $MgSO_4$. Volatile material was removed by vacuum distillation at 120° C. and 0.1 mm to recover the alkylation product. Using the same procedure and HVI-PAO olefin as starting material and anisole and naphthalene was alkylated with results presented below for Products 1–3.

EXAMPLE 9

In this Example, the reactions (4–7) are carried out in a similar manner to Example 8 except that a HVI-PAO polyalpha-olefin of 145.2 cS measured at 100° C. is used as starting material and toluene, pseudocumene, anisole and naphthalene are alkylated.

In Table 5 below the results of Examples 8 and 9 are presented. The results demonstrate that the alkylated products have very low unsaturations, as indicated by bromine number, and retain the high viscosity and pour points of the starting HVI-PAO olefin. Accordingly, the unique structure of the HVI-PAO moiety responsible for high VI and low pour point survives the alkylation reaction.

TABLE 5

| Product HVI-PAO | Aromatic | Wt % | Bromine number | Lubricant cS @ 100° C. | Properties VI | Pour Pt |
|---|---|---|---|---|---|---|
| Control | none | 0.0 | 11.3 | 18.2 | 164 | <−52° C. |
| 1 | toluene | 5.5 | 1.1 | 26.0 | 147 | <−42° C. |
| 2 | anisole | 6.5 | 0.7 | 28.0 | 148 | <−43° C. |
| 3 | naphthalene | 7.5 | 1.6 | 39.0 | 139 | −36° C. |
| Control | none | 0.0 | 3.0 | 145.2 | 212 | −37° C. |
| 4 | toluene | 1.2 | 2.4 | 140.7 | 210 | −40° C. |
| 5 | pseudocumene | 1.8 | 0.6 | 166.3 | 205 | −24° C. |
| 6 | anisole | 1.6 | 0.6 | 156.7 | 210 | −40° C. |
| 7 | naphthalene | 1.9 | 0.6 | 217.0 | 213 | −31° C. |

The low unsaturation of the alkylaromatic products, as evidenced by their low bromine number, eliminates the conventional hydrofinishing step usually required for lubricant basestock production, providing an additional advantage by improving the overall economics of the HVI-PAO process although a post-alkylation hydrotreating step may be used if desired to ensure that theproduct is fully saturated.

The products of the present invention demonstrate higher thermally stability compared to HVI-PAO. The thermal stability of alkylation products (Example 9, products 4–7 from 145.2 cS HVI-PAO) were examined by measuring the loss of viscosity (ΔV @ 100° C.) after heating at 280° C. for 24 hours under inert atmosphere. The results are shown in Table 6 below. These data demonstrate that addition of aromatic functional groups to HVI-PAO olefins reduces the viscosity loss and give a lubricant basestock with better thermal stability.

TABLE 6

| Product | Aromatic | Viscosity Loss, ΔV, % |
|---|---|---|
| HVI-PAO | none | 68 |
| 4 | toluene | 63 |
| 5 | pseudocumene | 46 |
| 6 | anisole | 16 |

TABLE 6-continued

| Product | Aromatic | Viscosity Loss, ΔV, % |
|---|---|---|
| 7 | naphthalene | 31 |

EXAMPLE 10

This Example illustrates the alkylation of phenol with olefinic HVI-PAO oligomer.

A mixture of 101 g of HVI-PAO oligomer (viscosity of 18 cS, measured at 100° C.), 27 g of phenol (12 wt. pct.) , 40 ml of heptane and 8 g of Amberlyst 15 acid catalyst was heated to 80° C. for 24–72 hours under inert atmosphere. The mixture was filtered while hot to remove the solid catalysts. The product was obtained after vacuum distillation (up to 160° C./0.1 mm) to remove solvent and excess phenol. The thermal stability of the above alkylphenol was examined by determining the temperature for 50% weight loss using thermal gravimetric analysis (TGA) and by measuring the viscosity loss (,&V) after heating to 280° C. and 300° C. for 24 hours under inert atmosphere. In the following Table 7 the properties and thermal stability of alkylated phenol is compared with a control of hydrogenated HVI-PAO.

TABLE 7

| Property | Control | HVI-PAO alkylphenol |
|---|---|---|
| Viscosity cS, 100° C. | 18.2 | 21.4 |
| Viscosity Index | 164 | 145 |
| Pour Point, °C. | <−52 | <−45 |
| Temp. for 50% Wt. loss, °C. | 388 | 402 |
| ΔV 280° C. | 41.6 | 3.0 |
| ΔV 300° C. | 57.5 | 27.9 |

This Table shows that the HVI-PAO alkylated phenol is more thermally stable than the hydrogenated HVI-PAO control.

EXAMPLE 11

In this example the alkylation process was carried out under more severe reaction conditions than described in previous Examples. These conditions include, carrying out the reaction in contact with higher concentrations of acid catalyst and at elevated temperatures and under these conditions of higher severity the reaction proceeds by both alkylation and isomerization.

A mixture of 50 gms. of unhydrogenated HVI-PAO, prepared according to the method described in Example 6 were mixed with aluminum chloride and 1,2,4-trimethylbenzene in 200 ml of heptane in the proportions and under the conditions described in Table 8 for Examples 11.1, 11.2, 11.3, and 11.4. The mixture was heated to 60° C. for twenty four hours. The reaction was quenched with water and the organic layer separated and washed with 5% HCl twice. The material was then hydrogenated at 80° C. under 300 psi of hydrogen for six hours with nickel on kieselguhr as catalyst. The product properties are listed also in the Table below and are compared to the product properties of the starting HVI-PAO.

TABLE 8

| Example | $AlCl_3$ % | Aro-matics % | V @ 100° C., cS | VI | Pour Pt. |
|---|---|---|---|---|---|
| HVI-PAO | 0.0 | 0.0 | 145.0 | 212 | −30° C. |
| 11.1 | 2.5 | 2.1 | 173.7 | 204 | −24° C. |
| 11.2 | 5.8 | 2.3 | 142.9 | 193 | — |
| 11.3 | 10.0 | 2.0 | 142.9 | 192 | −25° C. |
| 11.4 | 5.1 | 4.0 | 143.8 | 197 | −30° C. |

The unique structure of these product was confirmed by NMR and IR analysis.

The thermal stabilities of the products prepared were determined by measuring the percent viscosity loss (ΔV) after heating to 280° C. and 300° C. for twenty four hours in inert atmosphere. Each sample weighing approximately five grams is degassed at 60° C. under vacuum for two hours. The products were then heated to 280° C. or 300° C. under static nitrogen for twenty-four hours. The viscosities of these thermally treated materials are measured and compared to the starting product. The results are presented in Table 9 below. The results clearly show that the products prepared in these Examples are substantially more thermally stable as shown by the lower degree of viscosity loss after thermal treatment.

TABLE 9

| Product | ΔV 280° C. | ΔV 300° C. |
|---|---|---|
| HVI-PAO | 65.1 | 76.0 |
| Ex.11.1 | 29.7 | 54.7 |
| Ex.11.2 | 14.9 | 31.5 |
| Ex.11.3 | 14.6 | 22.6 |
| Ex.11.4 | 11.4 | 23.6 |

We claim:

1. An alkylaromatic hydrocarbon composition having the structure

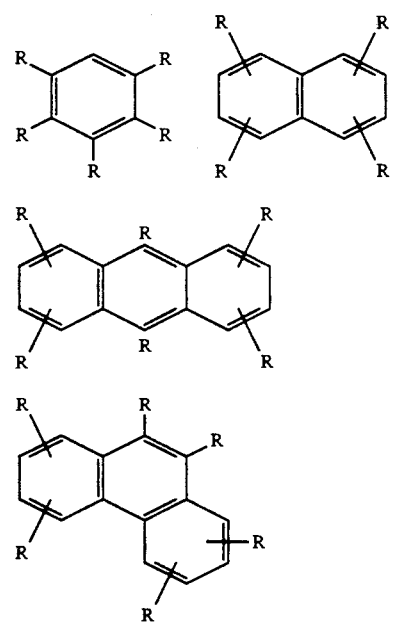

where at least one R group is the hydrocarbon residue derived from an olefin oligomer having a branch ratio of less than 0.19 produced by the oligomerization of a $C_2$–$C_{20}$ 1-alkene; and where the remaining R groups are hydrogen, $C_1$–$C_{20}$ cyclic or acyclic alkyl and alkenyl, aryl, $NH_2$, acylamido, halogen, acyl, $NO_2$, YO and YS where Y is hydrogen, acyl, alkoxycarbonyl, phenyl and $C_1$–$C_{20}$ cyclic or acyclic alkyl and alkenyl.

2. A composition according to claim 1 in which the hydrocarbon residue of the oligomer has a weight average molecular weight between 280 and 450,000, number average molecular weight between 280 and 180,000 and a molecular weight distribution between 1 and 5.

3. A composition according to claim 1 in which the remaining R groups are hydrogen.

4. The composition of claim 1 in which the alkylaromatic comprises an alkylated benzene, alkylated naphthalene, alkylated toluene or alkylated phenol.

5. The composition of claim 1 comprising the hydrogenation product of the alkylaromatic hydrocarbon having a bromine number between 0 and 12.

6. The composition of claim 1 in which the alkylaromatic has a viscosity at 100° C. between 2 cS and 1000 cS. and a pour point below −15° C.

7. The composition of claim 1 in which the hydrocarbon residue contains between 20 and 1300 carbon atoms.

8. The composition of claim 1 in which the alkylaromatic hydrocarbon has a bromine number between 0.1 and 12.

9. The composition of claim 1 in which the hydrocarbon residue has a molecular weight distribution between 1.05 and 2.5.

10. A method for improving the viscosity index and thermal stability of lubricant basestock comprising mixing with said lubricant basestock a VI and thermal stability enhancing amount of an alkylaromatic hydrocarbon made by the process comprising:

contacting an aromatic hydrocarbon and $C_{20}$–$C_{1300}$ olefinic hydrocarbon having a branch ratio less than 0.19 and pour point less than −15° C. in an alkylation zone with acidic alkylation catalyst under alkylation conditions to form an aromatic hydrocarbon having a viscosity index greater than 130;

separating and recovering the alkylated aromatic hydrocarbon.

* * * * *